US011458351B2

(12) United States Patent
Small et al.

(10) Patent No.: US 11,458,351 B2
(45) Date of Patent: Oct. 4, 2022

(54) PORTABLE FULL BODY RESISTANCE TRAINING DEVICE

(71) Applicant: NEW YORK UNIVERSITY, New York, NY (US)

(72) Inventors: William Small, New York, NY (US); Andrew Adelsheimer, New York, NY (US)

(73) Assignee: NEW YORK UNIVERSITY, New York, NY (US)

( * ) Notice: Subject to any disclaimer, the term of this patent is extended or adjusted under 35 U.S.C. 154(b) by 140 days.

(21) Appl. No.: 16/783,704

(22) Filed: Feb. 6, 2020

(65) Prior Publication Data

US 2020/0246658 A1 Aug. 6, 2020

Related U.S. Application Data

(60) Provisional application No. 62/801,736, filed on Feb. 6, 2019.

(51) Int. Cl.

| | |
|---|---|
| ***A63B 21/00*** | (2006.01) |
| ***A63B 21/002*** | (2006.01) |
| ***A63B 21/055*** | (2006.01) |
| ***A63B 21/04*** | (2006.01) |

(52) U.S. Cl.

CPC ..... *A63B 21/4033* (2015.10); *A63B 21/0023* (2013.01); *A63B 21/0442* (2013.01); *A63B 21/0557* (2013.01); *A63B 2225/093* (2013.01)

(58) Field of Classification Search

CPC ..... A63B 21/4033; A63B 21/0023; A63B 21/0557; A63B 21/0442; A63B 2225/093; A63B 23/0405; A63B 23/1209; A63B 21/4029; A63B 2210/04; A63B 2225/50

See application file for complete search history.

(56) References Cited

U.S. PATENT DOCUMENTS 4,896,881 A * 1/1990 Djerdjerian ..... A63B 21/1627 482/148
4,973,045 A * 11/1990 Heberer ..... A63B 69/004 482/83
5,820,532 A * 10/1998 Oliver ..... A63B 21/1672 482/123
5,839,991 A * 11/1998 Hall ..... A63B 23/00 482/23

(Continued)

OTHER PUBLICATIONS

Aagaard, Per, et al. "Role of the nervous system in sarcopenia and muscle atrophy with aging: strength training as a countermeasure." Scandinavian journal of medicine & science in sports 20.1 (2010): 49-64.

(Continued)

*Primary Examiner* — Andrew S Lo
(74) *Attorney, Agent, or Firm* — Riverside Law LLP

(57) ABSTRACT

The present invention relates to a lightweight, portable full-body resistance training exercise device. The device is attachable to a planar edge, such as a footboard, headboard, or sideboard of a bed. The device supports a plurality of mounting points for mounting straps and resistance bands. The device permits the position of the resistance bands to be adjusted for optimal anatomic positioning. The device allows for incremental adjustment of resistance to suit a user's strength and training protocol.

19 Claims, 10 Drawing Sheets

(56) References Cited

U.S. PATENT DOCUMENTS

| | | | | |
|---|---|---|---|---|
| 6,217,490 | B1 * | 4/2001 | Wurtak | A63B 69/004 248/316.4 |
| 6,890,289 | B2 * | 5/2005 | Spinosa | A63B 23/02 482/140 |
| 9,192,807 | B2 * | 11/2015 | Spinosa | A63B 21/1672 |
| 9,393,455 | B2 * | 7/2016 | Salamon | A63B 21/1672 |
| 9,393,474 | B2 * | 7/2016 | Smejkal | A63B 69/002 |
| 9,586,077 | B2 * | 3/2017 | Kabasso | A63B 21/0552 |
| 9,868,006 | B1 * | 1/2018 | Epler | A63B 21/1636 |
| 2002/0035016 | A1 * | 3/2002 | Weiss | A63B 1/00 482/34 |
| 2006/0035750 | A1 * | 2/2006 | Weiss | A63B 1/00 482/34 |
| 2006/0287172 | A1 * | 12/2006 | Spinosa | A63B 23/0211 482/140 |
| 2009/0062040 | A1 * | 3/2009 | Gayed | A63B 69/0097 473/483 |
| 2013/0109548 | A1 * | 5/2013 | Levitin | A63B 21/4043 482/139 |
| 2015/0105188 | A1 * | 4/2015 | Smejkal | A63B 69/0095 473/432 |
| 2015/0273265 | A1 * | 10/2015 | Spinosa | A63B 21/4037 482/140 |
| 2017/0232316 | A1 * | 8/2017 | Chu | A63B 63/083 473/482 |

OTHER PUBLICATIONS

Adamson, Simon B., et al. "Extremely Short-Duration High□Intensity Training Substantially Improves the Physical Function and Self□Reported Health Status of Elderly Adults." Journal of the American Geriatrics Society 62.7 (2014): 1380-1381.

Brown, Cynthia J., et al. "The underrecognized epidemic of low mobility during hospitalization of older adults." Journal of the American Geriatrics Society 57.9 (2009): 1660-1665.

Buford, Thomas W., et al. "Models of accelerated sarcopenia: critical pieces for solving the puzzle of age-related muscle atrophy." Ageing research reviews 9.4 (2010): 369-383.

Cadore, Eduardo L., et al. "Multicomponent exercises including muscle power training enhance muscle mass, power output, and functional outcomes in institutionalized frail nonagenarians." Age 36.2 (2014): 773-785.

Comans, Tracy A., et al. "The increase in healthcare costs associated with frailty in older people discharged to a post-acute transition care program." Age and ageing 45.2 (2016): 317-320.

Corcoran, John R., et al. "Early rehabilitation in the medical and surgical intensive care units for patients with and without mechanical ventilation: an interprofessional performance improvement project." PM&R 9.2 (2017): 113-119.

Davis, Jennifer C., et al. "Sustained cognitive and economic benefits of resistance training among community-dwelling senior women: a 1-year follow-up study of the Brain Power study." Archives of internal medicine 170.22 (2010): 2036-2038.

Falvey, Jason R., Kathleen K. Mangione, and Jennifer E. Stevens-Lapsley. "Rethinking hospital-associated deconditioning: proposed paradigm shift." Physical therapy 95.9 (2015): 1307-1315.

Fisher, Nadine M., David R. Pendergast, and Evan Calkins. "Muscle rehabilitation in impaired elderly nursing home residents." Archives of physical medicine and rehabilitation 72.3 (1991): 181-185.

Gordon, Brett R., et al. "Association of efficacy of resistance exercise training with depressive symptoms: meta-analysis and meta-regression analysis of randomized clinical trials." JAMA psychiatry 75.6 (2018): 566-576.

Janssen, Ian, et al. "The healthcare costs of sarcopenia in the United States." Journal of the American Geriatrics Society 52.1 (2004): 80-85.

Liu, Chiung□ju, and Nancy K. Latham. "Progressive resistance strength training for improving physical function in older adults." Cochrane database of systematic reviews 3 (2009).

Narici, Marco V., et al. "Muscular adaptations to resistance exercise in the elderly." Journal of musculoskeletal and neuronal interactions 4.2 (2004): 161-164.

Pereira, Ana, et al. "Effects of high-speed power training on functional capacity and muscle performance in older women." Experimental gerontology 47.3 (2012): 250-255.

Peterson, Mark D., and Paul M. Gordon. "Resistance exercise for the aging adult: clinical implications and prescription guidelines." The American journal of medicine 124.3 (2011): 194-198.

Sagiv, Michael. "Safety of resistance training in the elderly." (2009): 1-2.

* cited by examiner

PORTABLE FULL BODY RESISTANCE TRAINING DEVICE

CROSS-REFERENCE TO RELATED APPLICATIONS

This application claims priority to U.S. Provisional Patent Application No. 62/801,736, filed Feb. 6, 2019, the contents of which are incorporated by reference herein in its entirety.

BACKGROUND OF THE INVENTION

Sarcopenia, the age-related degradation of muscle quantity, quality, and regenerative capacity, cost the US $18.5 billion in 2000 by conferring an increased risk of disability, disease comorbidity, and increased healthcare expenditures. In addition to the loss of 1-2% of muscle mass per year after the age of 50, older adults experience dramatic changes in their neuromuscular systems. Aagaard et al demonstrated a loss of 25% of spinal motor neurons from 20-90 years old (Aagaard P et al., Scandinavian journal of medicine & science in sports, 2010, 20(1):49-64). Sarcopenia and neuromuscular degradation are foundational to frailty, a progressive syndrome of weakness and immobility, and a strong predictor of functional decline, falls, mortality, readmissions, and utilization of post-acute care. When older adults are hospitalized, deconditioning (immobilization from bedrest), acts synergistically with frailty to further destroy their skeletal muscle, and thus, their functional reserves, predisposing them to worse outcomes (Falvey J R et al., Physical therapy, 2015, 95(9):1307-1315; Cadore E L et al., Age, 2014, 36(2):773-785; Fisher N M et al., Archives of physical medicine and rehabilitation, 1991, 72(3):181-185). Despite the lack of evidence supporting aerobic training alone as a modality to improve muscle mass, functional performance, or disability in frail older adults, the foundations of institutional rehabilitation remain ambulation and general conditioning activities instead of resistance training (Falvey J R et al., Physical therapy, 2015, 95(9):1307-1315; Aagaard P et al., Scandinavian journal of medicine & science in sports, 2010, 20(1):49-64). Adults greater than 65 years old, who comprise over 35% of hospitalizations and have longer lengths of stay, are the fastest growing segment of the global population. Seniors utilize exponentially more healthcare as they age; there should be a sense of urgency to redesign how institutions prevent deconditioning.

The dramatic loss of skeletal muscle with deconditioning affects approximately 40 million people over 65 per year and can have catastrophic consequences, for skeletal muscle represents the body's only reservoir of readily available amino acids for both energy and response to acute stressors. Due to rapidly diminished functional reserve, hospitalized older adults are 61 times more likely to develop disability in activities of daily living (Falvey J R et al., Physical therapy, 2015, 95(9):1307-1315), such as bathing or feeding themselves, and are at greater risk for cognitive decline. Bedrest compounds the effects of sarcopenia, rapidly inducing atrophy through protein loss, increased oxidative stress, and deinnervation. Immobilization dramatically reduces the amount of muscle capillaries and exercise capacity through further atrophy and thickening of surrounding connective tissue (Buford T W et al., Ageing research reviews, 2010, 9(4):369-383; Brown C J et al., Journal of the American Geriatrics Society, 2009, 57(9):1660-1665; Corcoran J R et al., PM&R, 2017, 9(2):113-119; Falvey J R et al., Physical therapy, 2015, 95(9):1307-1315; Liu C J et al., The Cochrane database of systematic reviews, 2009, (3): CD002759; Davis J C et al., Archives of internal medicine, 2010, 170(22):2036-2038; Aagaard P et al., Scandinavian journal of medicine & science in sports, 2010, 20(1):49-64; Peterson M D et al., The American journal of medicine, 2011, 124(3):194-198)).

Though deconditioning is an increasingly recognized problem, a 2009 study by the American Geriatric Society found that, over a 4 day period, hospitalized patients spent 83% of their time lying in bed and an additional 12% in a chair (Brown C J et al., Journal of the American Geriatrics Society, 2009, 57(9):1660-1665). Even when patients want to get up, restraining medical devices (IV lines, catheters), infections, and concerns about falls act as barriers to mobility. Deconditioning also leads to more frequent falls, nursing home placements, and hospitalizations, such that 1 in 5 Medicare beneficiaries are re-hospitalized within 30 days (Falvey J R et al., Physical therapy, 2015, 95(9):1307-1315). Teams directed at improving patient functional status, such as occupational and physical therapy, are often overburdened and must prioritize patients with the most immediate need for rehabilitation. In acute hospitals, patients deemed eligible may receive therapy for 15 minutes every few days, while others may only be seen once or twice during their entire stay. In subacute facilities, the two to three hours of therapy provided to patients encompass a wide range of activities, and strength training received is operator dependent. Innovative solutions are required to temper the growing epidemic of deconditioning.

Deconditioning represents a significant but modifiable economic burden on healthcare institutions, and costs will continue to escalate until effective clinical innovations are introduced. The excess expenditures associated with sarcopenia were $860 and $933 for men and women, respectively (not including indirect costs such as lost productivity). Further supporting the need to prevent deconditioning, Comans et al showed that frailty index was directly correlated with length of stay, re-hospitalization rate, and higher healthcare costs over 6 months, and inversely correlated with discharge home (Comans T A et al., Age and ageing, 2016, 45(2):317-320). Fortunately, given seniors' remarkable plasticity in both their skeletal muscle and neuromuscular system in response to resistance training (RT), there exists a safe, time-efficient, and efficacious countermeasure to age- and bedrest-related functional decline, even in institutionalized nonagenarians (90-99 years old) (Liu C J et al., The Cochrane database of systematic reviews, 2009, (3): CD002759; Davis J C et al., Archives of internal medicine, 2010, 170(22):2036-2038; Aagaard P et al., Scandinavian journal of medicine & science in sports, 2010, 20(1):49-64; Peterson M D et al., The American journal of medicine, 2011, 124(3):194-198; Cadore E L et al., Age, 2014, 36(2): 773-785; Pereira A et al., Experimental gerontology, 2012, 47(3):250-255; Adamson S B et al., Journal of the American Geriatrics Society, 2014, 62(7):1380-1381; Fisher N M et al., Archives of physical medicine and rehabilitation, 1991, 72(3):181-185; Gordon B R et al., JAMA psychiatry, 2018, 75(6):566-576; Narici M V et al., Journal of musculoskeletal and neuronal interactions, 2004, 4(2):161-164; Sagiv M, European review of aging and physical activity, 2009, 6:1).

Resistance rather than aerobic exercise may be the preferred training modality for preventing deconditioning in the elderly given it improves muscle mass, strength, and power in a dose-dependent manner, even in the very old. Resistance training for older adults is deemed evidence category A and is recommended 3-4 times per week for its crucial role as a safe, efficient countermeasure to the degenerative effects of aging and deconditioning (Sagiv M, European review of aging and physical activity, 2009, 6:1).

Throughout their lives, the skeletal muscle and functionality of older adults maintain a remarkable plasticity in response to RT. Muscle mass increases quickly after RT and allows for faster and more proficient skeletal muscle regeneration. In addition, muscle quality improves in response to RT through improved coordination of motor units via reinnervation and through reduced inflammation and oxidative damage. A Cochrane meta-analysis of 121 clinical trials found that for older adults, resistance training significantly improved muscle strength and independence, and reduced pain in arthritic joints (Corcoran J R et al., PM&R, 2017, 9(2):113-119). Cadore et al showed that even frail nonagenarians (90-99 years old) improve their muscle mass, functional performance, and decrease fall incidence after RT (Cadore E L et al., Age, 2014, 36(2):773-785).

Strength training elicits significant improvements in neuromuscular and cognitive function in the elderly. Improvements in motor unit recruitment, balance, and fine motor control have all been associated with RT. In contrast, excessive endurance training may decrease muscle fiber innervation. A 2018 JAMA Psychiatry meta-analysis revealed RT significantly reduces depressive symptoms (Gordon B R et al., JAMA psychiatry, 2018, 75(6):566-576). In addition, elderly patients who receive 4-6 weeks of supervised resistance training have been shown to sustain at least 12 months of cognitive benefits (e.g., selective attention, depression), fewer falls, and incurred fewer care utilization costs than the controls (Comans T A et al., Age and ageing, 2016, 45(2): 317-320). RT, which reverses deleterious effects of aging and immobilization, should thus be the main prophylactic modality for deconditioning.

Through the absence of intuitive resistance training products and a reliance on aerobic exercise and passive mobility, the current dogma within healthcare regarding the treatment of deconditioning fails to meet standards proposed by the American Physical Therapy Association and the Journal of Disability and Rehabilitation. Aging, frail patients are especially vulnerable to the lack of products geared to mitigate the detrimental effects of bedrest. For example, U.S. Pat. No. 9,393,455 describes a bed exercise device mounted to the side rails of a bedframe with triangle frames engaging the underside of the bed, and requires unwieldy interchangable parts. U.S. Pat. No. 9,586,077B2 describes a bed apparatus that attaches to the lower frame and headboard of a regular bed and is cumbersome to install and remove. U.S. Patent Application Publication No. 2011/0166005A1 describes a portable exercise device that mounts to the underside of a bed frame, but does not enable full-body exercises. U.S. Pat. No. 6,152,855A is a portable in-bed exercise machine that uses closed kinetic chain exercise for isometric, isotonic, and isokinetic exercise. Despite being portable, this device wheels to the side of a bed and requires substantial user set-up. U.S. Pat. No. 4,976,426 describes a rehabilitation exercise device that is limited to exercises using a rotational hydraulic motor linked to an axial shaft to apply force to a user's limbs. Patients and their families are owed an exercise tool designed for them that can be used outside of reimbursed therapy time and which helps maintain long-term health.

There is a need in the art for improved devices for resistance training. The present invention meets this need.

SUMMARY OF THE INVENTION

In one aspect, the present invention relates to a full body resistance training device comprising: a frame having a backboard and at least one bracket, wherein the backboard and the at least one bracket are spaced apart to receive a planar edge; at least one clamping knob attached to the backboard, wherein the at least one clamping knob is actuatable towards and away from the at least one bracket; and at least one arm attached to the frame by a connection, wherein the connection between the arm and the frame is movable and lockable between a plurality of positions.

In one embodiment, the frame comprises at least one mounting point having a rigid small diameter cross-section. In one embodiment, the at least one bracket has a length that is longer than a length of the backboard. In one embodiment, the length of the at least one bracket is between about 12 and 36 inches. In one embodiment, the length of the backboard is between about 6 and 30 inches.

In one embodiment, the connection between the at least one arm and the frame is a pivoting connection. In one embodiment, the connection between the at least one arm and the frame is a sliding connection. In one embodiment, the at least one arm comprises an eyelet. In one embodiment, the at least one arm has a length between about 12 and 24 inches. In one embodiment, the at least one arm is telescoping such that the length is adjustable. In one embodiment, the at least one arm has a skeletal construction having one or more mounting points, each mounting point having a rigid small diameter cross-section. In one embodiment, the at least one arm is rigidly secured to an adjacent arm by at least one crossbar. In one embodiment, the at least one crossbar comprises one or more mounting points, each mounting point having a rigid small diameter cross-section.

In one embodiment, actuating the at least one clamping knob towards the at least one bracket grips a planar edge between the clamping knob and the at least one bracket to secure the frame to the planar edge. In one embodiment, the planar edge is selected from the group consisting of: a bed footboard, a bed headboard, and a bed sideboard.

In one embodiment, the device further comprises at least one mounting strap having a first end, a second end, and a length in between, wherein the first end has a swivel hook sized to fit over an eyelet or a mounting point having a rigid small diameter cross-section, and the second end has a loop sized to receive a resistance band. In one embodiment, the length is between about 6 and 36 inches. In one embodiment, the at least one mounting strap comprises a buckle such that the length is adjustable.

In another aspect, the present invention relates to a full body resistance training kit, comprising: the full body resistance training device of the present invention; and at least one resistance band. In one embodiment, the kit further comprises at least one mounting strap having a first end, a second end, and a length in between, wherein the first end has a swivel hook sized to fit over an eyelet or a mounting point having a rigid small diameter cross-section, and the second end has a loop sized to receive a resistance band.

BRIEF DESCRIPTION OF THE DRAWINGS

The following detailed description of exemplary embodiments of the invention will be better understood when read in conjunction with the appended drawings. It should be understood, however, that the invention is not limited to the precise arrangements and instrumentalities of the embodiments shown in the drawings.

DETAILED DESCRIPTION

Figure 1:
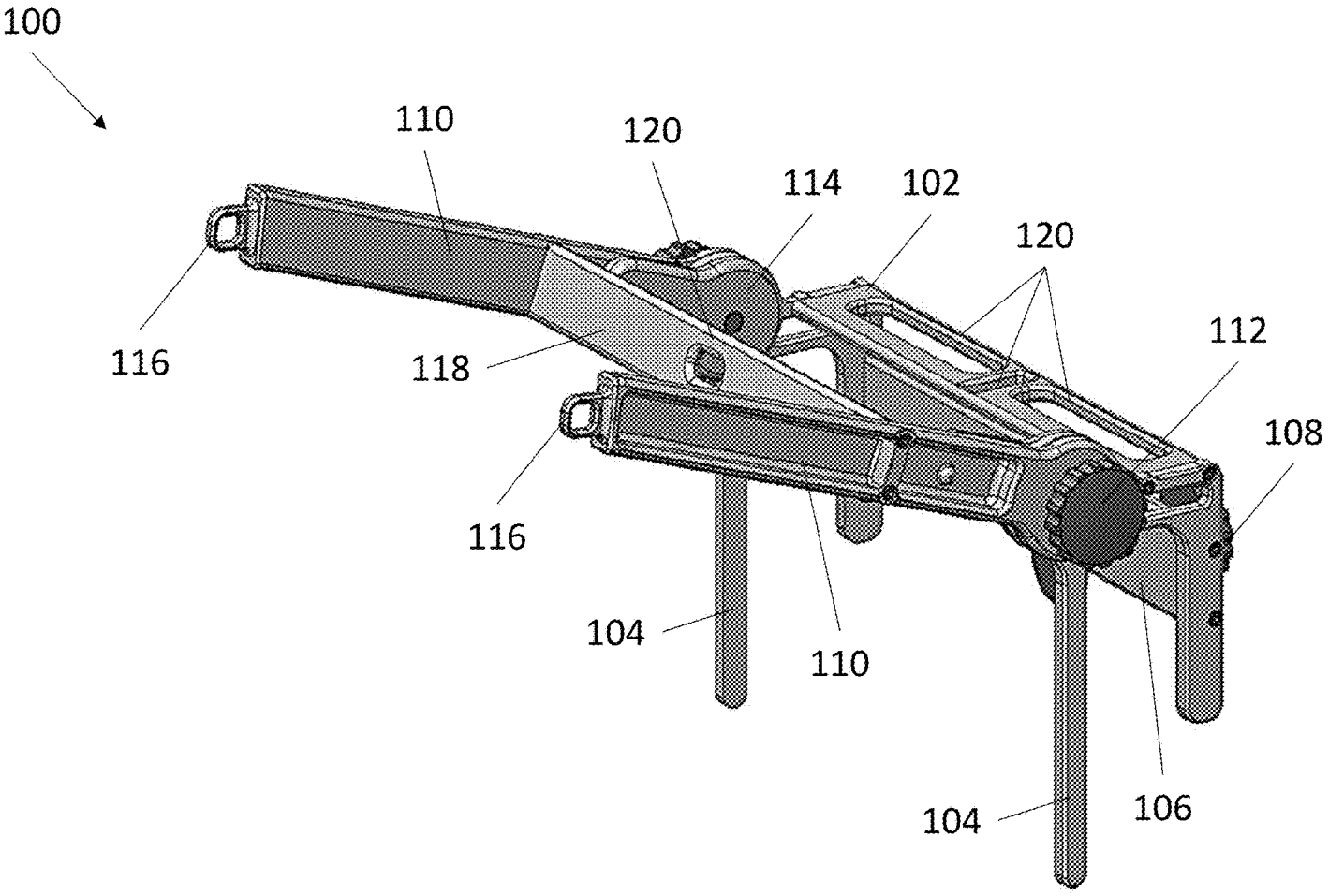
FIG. 1 depicts a perspective view of an exemplary resistance training device.

The present invention relates to a lightweight, portable full-body resistance training exercise device and methods of use. In certain embodiments, the device is attachable to a planar edge, such as a footboard, headboard, or sideboard of a bed. The device supports a plurality of mounting points for mounting straps and resistance bands. The device permits the position of the resistance bands to be adjusted for optimal anatomic positioning. The device allows for incremental adjustment of resistance to suit a user's strength and training protocol.

Definitions

It is to be understood that the figures and descriptions of the present invention have been simplified to illustrate elements that are relevant for a clear understanding of the present invention, while eliminating, for the purpose of clarity, many other elements typically found in the art. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined elsewhere, all technical and scientific terms used herein have the same meaning as commonly understood by one of ordinary skill in the art to which this invention belongs. Although any methods and materials similar or equivalent to those described herein can be used in the practice or testing of the present invention, exemplary methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3, 6, and any whole and partial increments there between. This applies regardless of the breadth of the range.

Resistance Training Device

In one aspect, the present invention provides full body resistance training devices that attach to a planar edge, such as a footboard, headboard, or sideboard of a bed. The devices employ resistance bands for resistance training in both the incursion (force applying) and excursion (force releasing) phase of exercise. The devices support a plurality of resistance bands and permit users to perform a range of exercises (including upper body, lower body, core, and back). The devices place resistance bands in optimal anatomic positions for the greatest number of muscles to be exercised safely. The devices are adaptable to any structure, such as a hospital or a home bed, for user recuperation and training. The devices permit adjustment of tension in resistance bands to adapt to the strength of any user and to adapt to changes in strength in each user.

Figure 2:
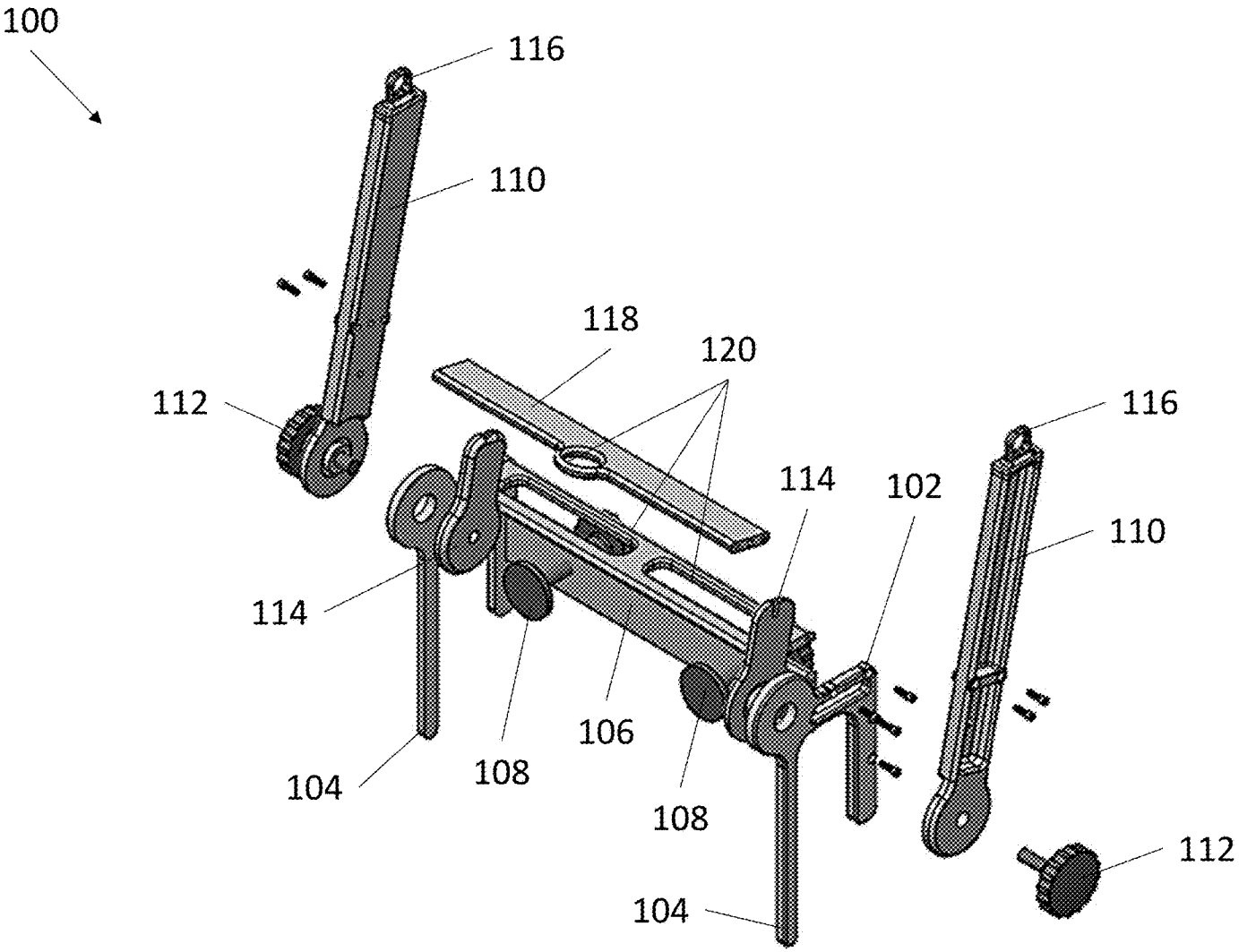
FIG. 2 depicts an exploded view of an exemplary resistance training device.
Figure 3:
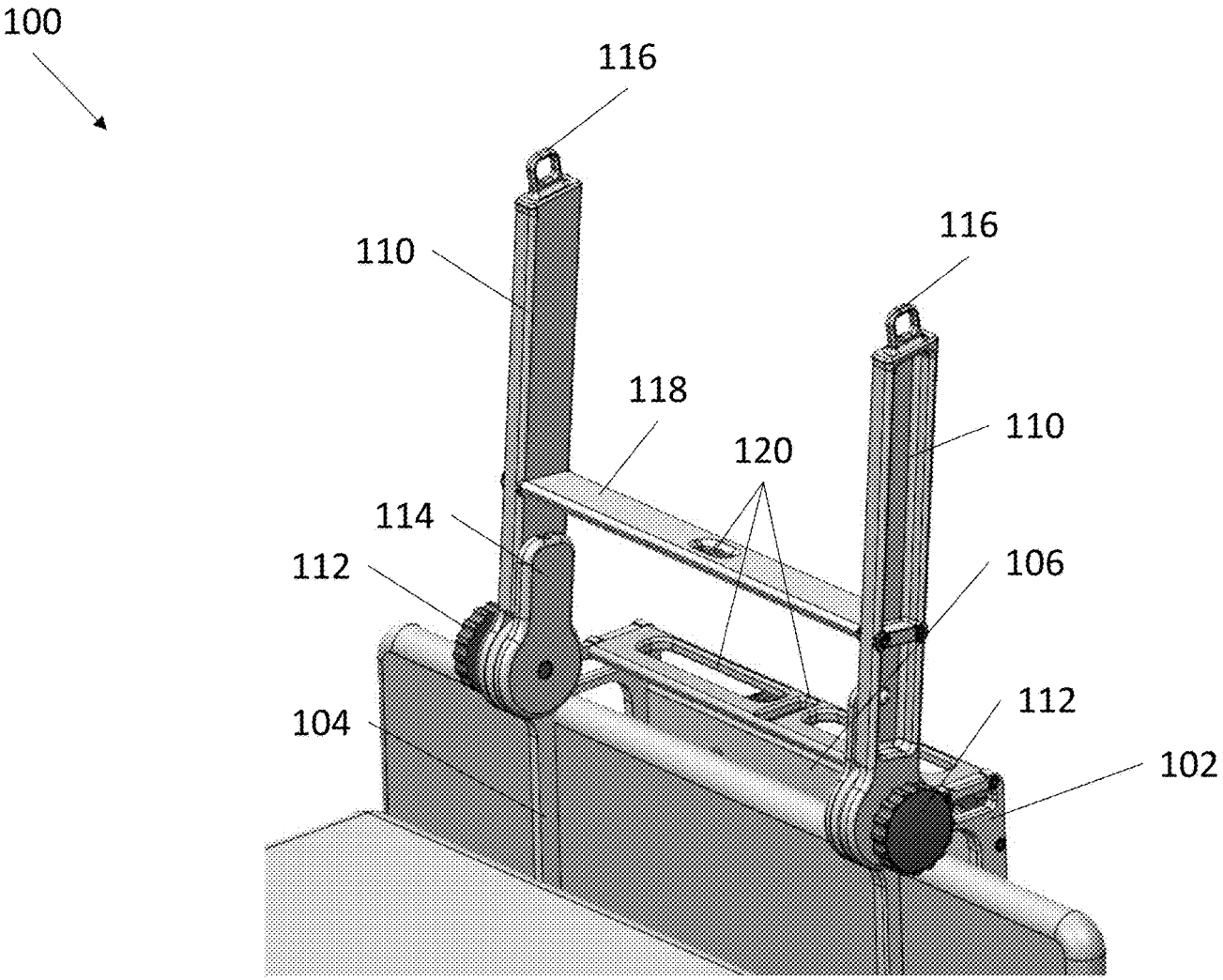
FIG. 3 depicts a perspective view of an exemplary resistance training device secured to the footboard of a bed.

Referring now to FIG. 1 through FIG. 3, an exemplary pivoting resistance training device 100 is depicted. Device 100 comprises frame 102 having one or more brackets 104, a backboard 106, and one or more clamp knobs 108. Brackets 104 and backboard 106 extend in an inferior direction from frame 102. In some embodiments, brackets 104 extend for a length that is longer than a length of backboard 106. For example, in some embodiments, brackets 104 can have a length of between about 12 to 36 inches and backboard 106 can have a length of between about 6 and 30 inches. Frame 102 is sized to straddle a planar edge, such as a footboard, headboard, or sideboard of a bed, such that brackets 104 and backboard 106 are positionable adjacent to opposing surfaces of a planar edge. Clamp knobs 108 are anchored to backboard 106 and can be actuated to extend and retract pads towards and away from brackets 104. Frame 102 is thereby securable to a planar edge by actuating clamp knobs 108 such that the planar edge is gripped between brackets 104 on one surface and the pads of clamp knobs 108 on an opposing surface. Frame 102 further comprises one or more mounting points 120, each mounting point 120 comprising a rigid, small diameter cross-section whereupon a mounting strap can be secured (as described elsewhere herein).

Device 100 further comprises a plurality of arms 110, each arm 110 having a first end, a second end, and a length in-between. Arms 110 can have any suitable length, such as a length between about 12 and 24 inches. Each arm 110 is attachable at the first end to frame 102 between knob 112 and clamping plate 114. Knob 112 screws into clamping plate 114 and can be actuated to tighten or loosen its grip on arm 110, thereby reversibly locking the pivot angle of arm 110 relative to frame 102. In some embodiments, at least one arm 110 comprises an eyelet 116 at the second ends. In some embodiments, at least one arm 110 comprises a skeletal construction having one or more mounting points 120 along its length (not pictured). In some embodiments, two or more arms 110 are interconnected by one or more crossbars 118, each crossbar 118 rigidly connecting one arm 110 to at least one adjacent arm 110. Crossbar 118 can comprise one or more mounting points 120.

Figure 4:
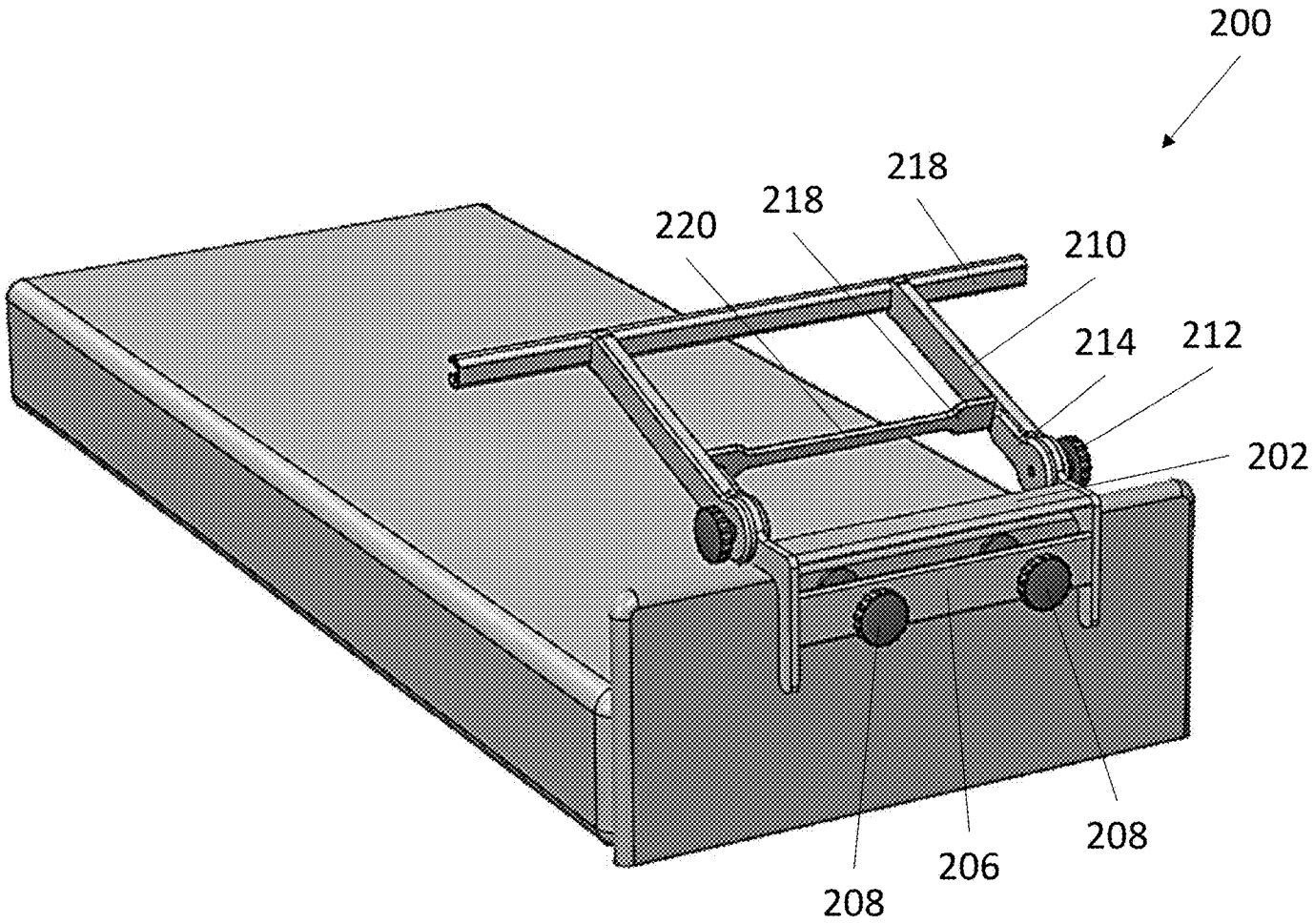
FIG. 4 depicts a perspective view of an exemplary resistance training device secured to the footboard of a bed.
Figure 5:
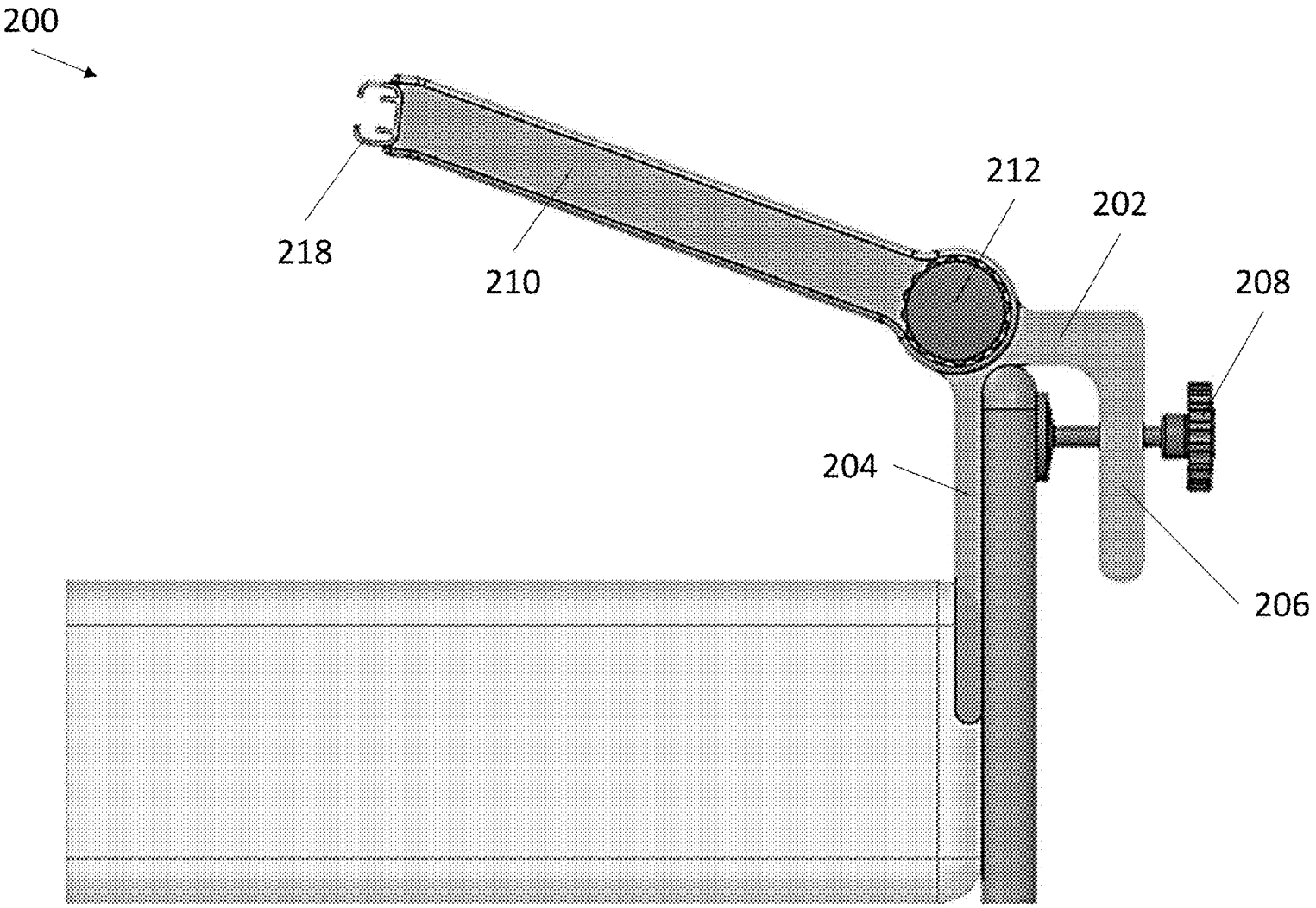
FIG. 5 depicts a side view of an exemplary resistance training device secured to the footboard of a bed.
Figure 6:
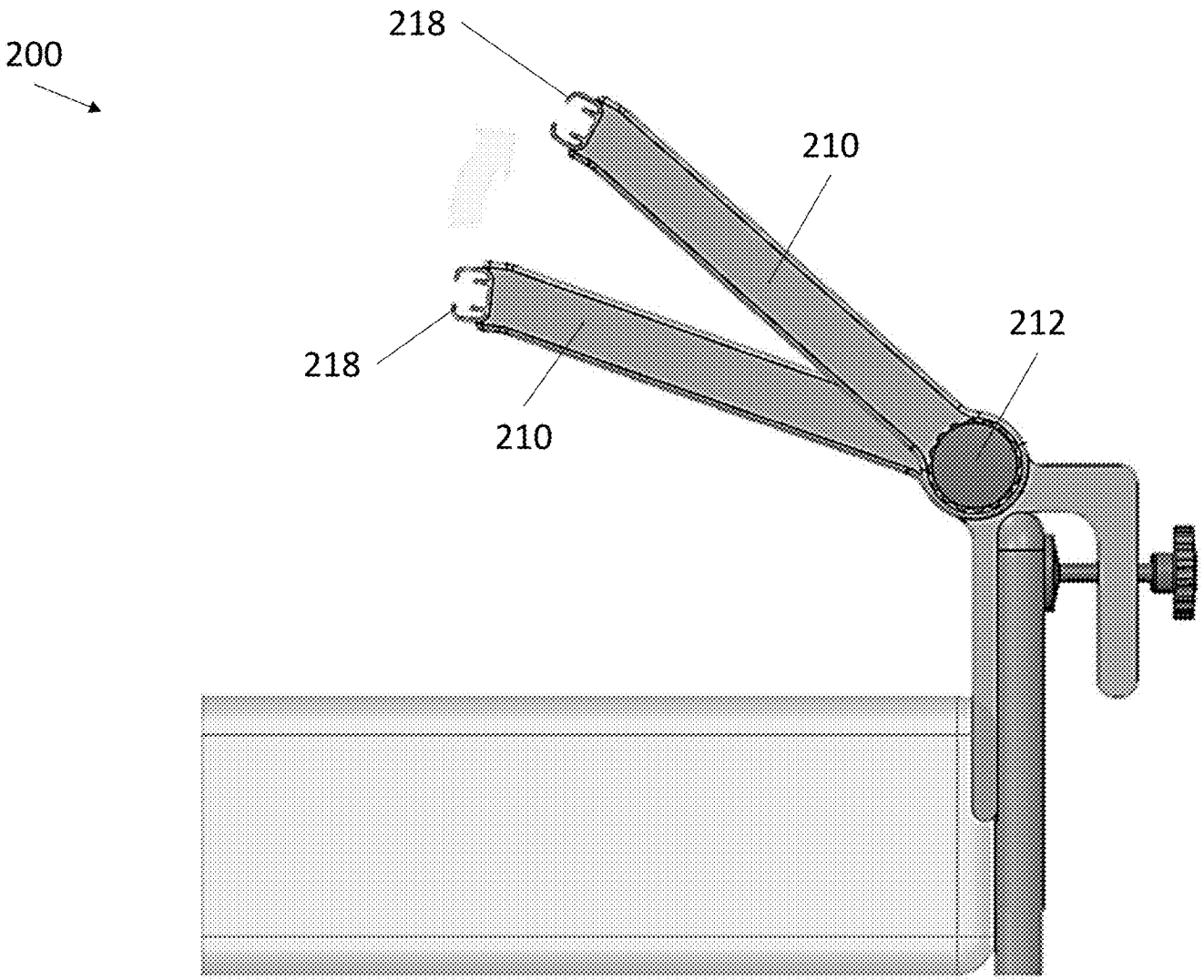
FIG. 6 depicts a side view of the pivoting adjustment of an exemplary resistance training device secured to the footboard of a bed.

Referring now to FIG. 4 through FIG. 6, an exemplary pivoting resistance training device 200 is depicted. Device 200 comprises frame 202 having one or more brackets 204, a backboard 206, and one or more clamp knobs 208. Brackets 204 and backboard 206 extend in an inferior direction from frame 202. In some embodiments, brackets 204 extend for a length that is longer than a length of backboard 206. For example, in some embodiments, brackets 204 can have a length of between about 12 to 36 inches and backboard 206 can have a length of between about 6 and 30 inches. Frame 202 is sized to straddle a planar edge, such as a footboard, headboard, or sideboard of a bed, such that brackets 204 and backboard 206 are positionable adjacent to opposing surfaces of a planar edge. Clamp knobs 208 are anchored to backboard 206 and can be actuated to extend and retract pads towards and away from brackets 204. Frame 202 is thereby securable to a planar edge by actuating clamp knobs 208 such that the planar edge is gripped between brackets 204 on one surface and the pads of clamp knobs 208 on an opposing surface. In some embodiments, frame 202 further comprises one or more mounting points 220 (not pictured), each mounting point 220 comprising a rigid, small diameter cross-section whereupon a mounting strap can be secured (as described elsewhere herein).

Device 200 further comprises a plurality of arms 210, each arm 210 having a first end, a second end, and a length in-between. Arms 210 can have any suitable length, such as a length between about 12 and 24 inches. Each arm 210 is attachable at the first end to frame 202 between knob 212 and clamping plate 214. Knob 212 screws into clamping plate 214 and can be actuated to tighten or loosen its grip on arm 210, thereby reversibly locking the pivot angle of arm 210 relative to frame 202 (as shown in FIG. 6). In some embodiments, at least one arm 210 comprises a skeletal construction having one or more mounting points 220 along its length (not pictured). In some embodiments, two or more arms 210 are interconnected by one or more crossbars 218, each crossbar 218 rigidly connecting one arm 210 to at least one adjacent arm 210. Crossbar 218 can comprise one or more mounting points 220.

Figure 7:
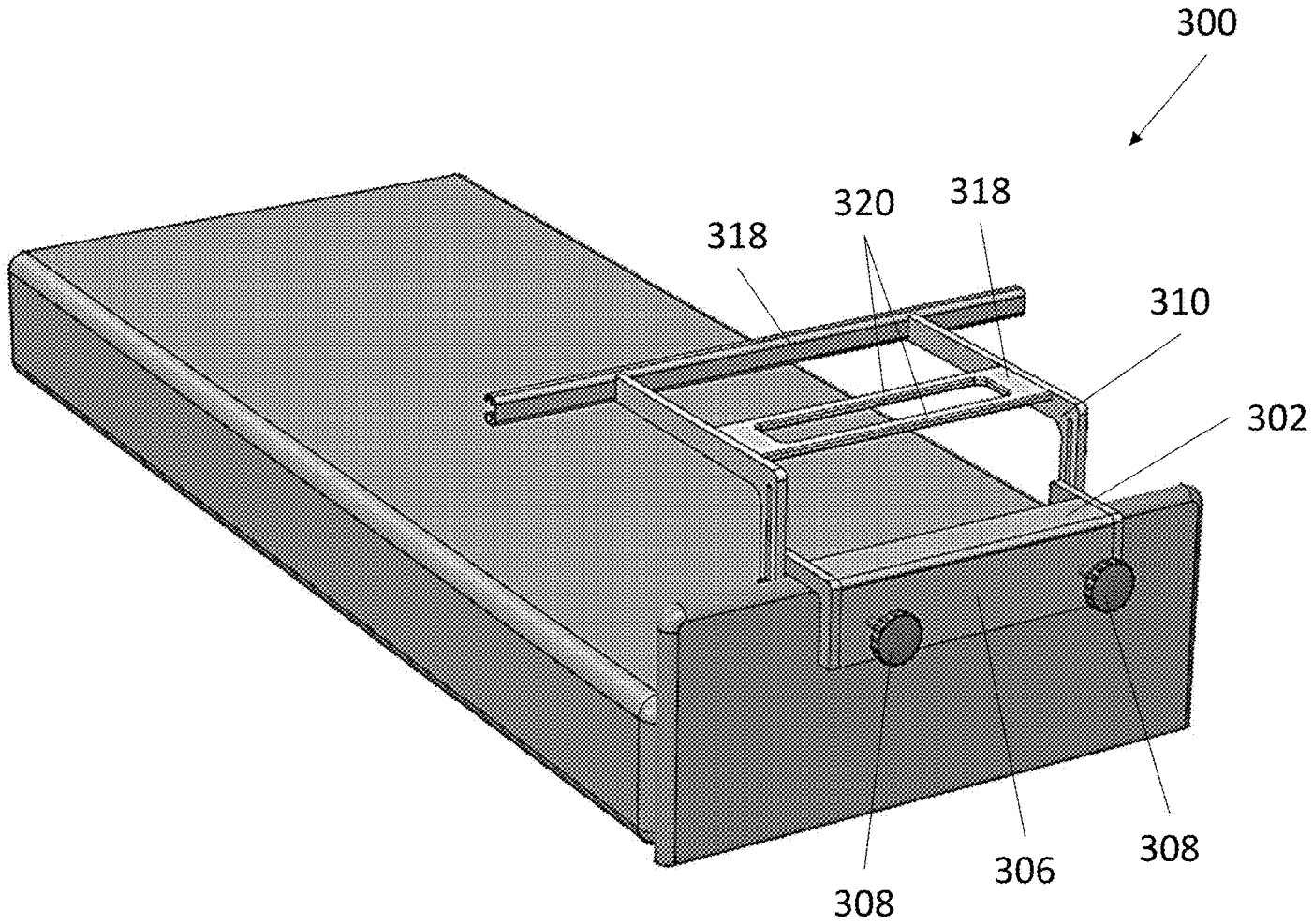
FIG. 7 depicts a perspective view of an exemplary resistance training device secured to the footboard of a bed.
Figure 8:
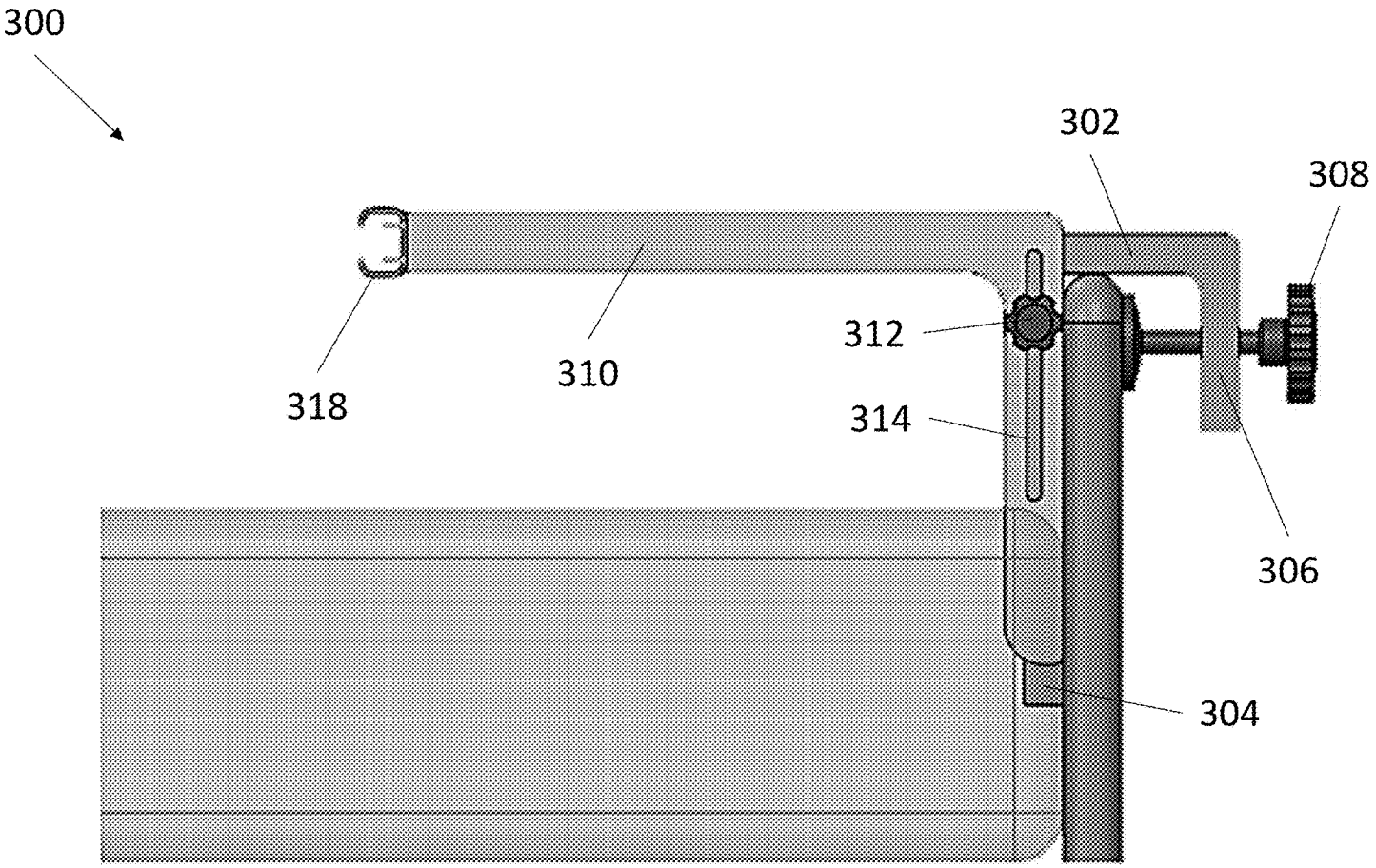
FIG. 8 depicts a side view of an exemplary resistance training device secured to the footboard of a bed.
Figure 9:
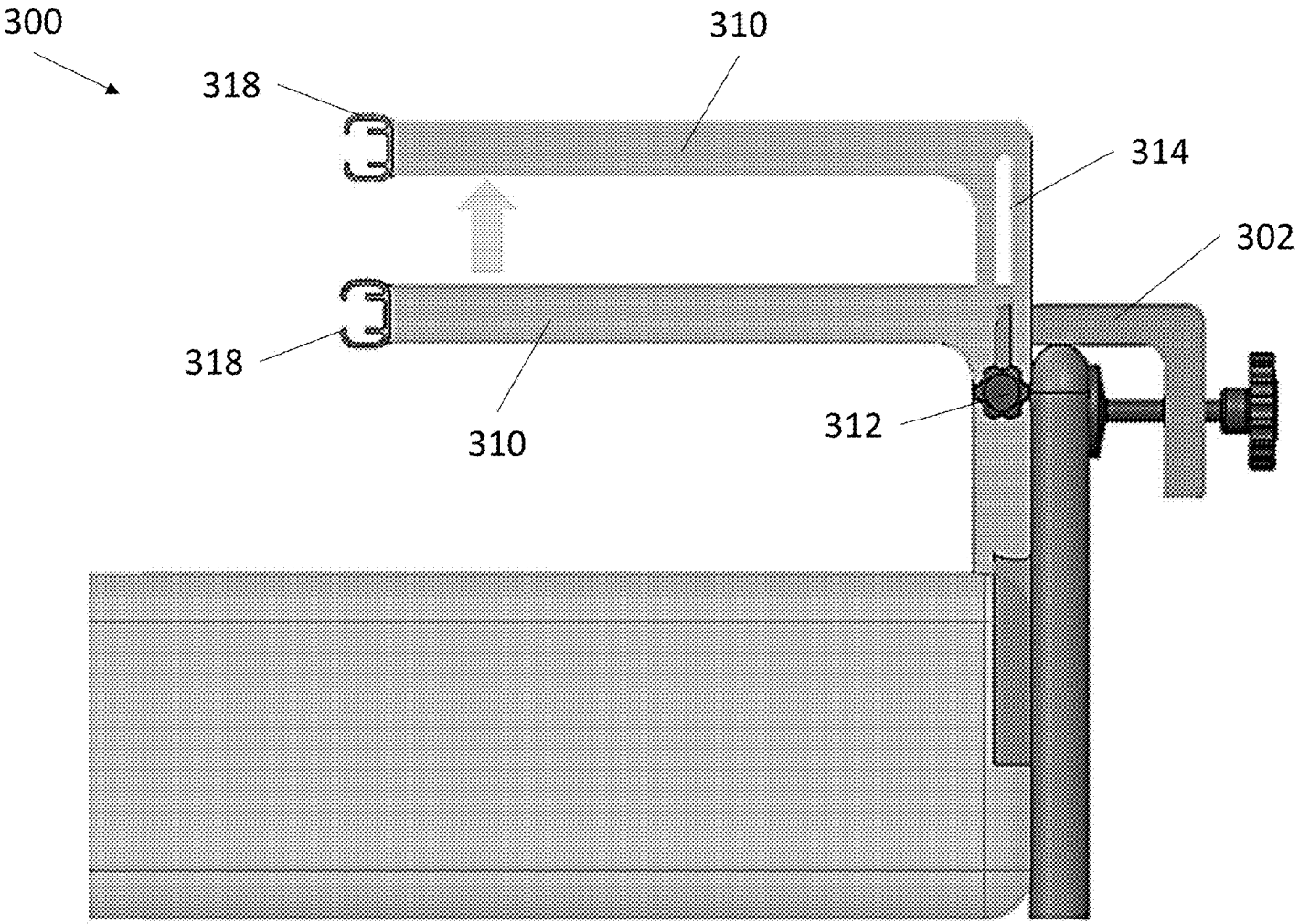
FIG. 9 depicts a side view of the sliding adjustment of an exemplary resistance training device secured to the footboard of a bed.

Referring now to FIG. 7 through FIG. 9, an exemplary sliding resistance training device 300 is depicted. Device 300 comprises frame 302 having one or more brackets 304, a backboard 306, and one or more clamp knobs 308. Brackets 304 and backboard 306 extend in an inferior direction from frame 302. In some embodiments, brackets 304 extend for a length that is longer than a length of backboard 306. For example, in some embodiments, brackets 304 can have a length of between about 12 to 36 inches and backboard 306 can have a length of between about 6 and 30 inches. Frame 302 is sized to straddle a planar edge, such as a footboard, headboard, or sideboard of a bed, such that brackets 304 and backboard 306 are positionable adjacent to opposing surfaces of a planar edge. Clamp knobs 308 are anchored to backboard 306 and can be actuated to extend and retract pads towards and away from brackets 304. Frame 302 is thereby securable to a planar edge by actuating clamp knobs 308 such that the planar edge is gripped between brackets 304 on one surface and the pads of clamp knobs 308 on an opposing surface. In some embodiments, frame 302 further comprises one or more mounting points 320 (not pictured), each mounting point 320 comprising a rigid, small diameter cross-section whereupon a mounting strap can be secured (as described elsewhere herein).

Device 300 further comprises a plurality of arms 310, each arm 310 having a first end, a second end, and a length in-between. Arms 310 can have any suitable length, such as a length between about 12 and 24 inches. In some embodiments, arms 310 can have one or more bends, such that the first end and the second end are oriented in different directions. For example, the first end can be oriented at any angle from the second end, such as an angle between about 90 degrees and 270 degrees. Each arm 310 comprises a linear slot 314 positioned along its length, such that each arm 310 is securable to frame 302 by at least one knob 312. The at least one knob 312 screws into frame 302 through slot 314 and can be actuated to tighten or loosen its grip on arm 310, thereby reversibly locking the sliding height of arm 310 relative to frame 302 (as shown in FIG. 9). In some embodiments, at least one arm 310 comprises a skeletal construction having one or more mounting points 320 along its length (not pictured). In some embodiments, two or more arms 310 are interconnected by one or more crossbars 318, each crossbar 318 rigidly connecting one arm 310 to at least one adjacent arm 310. Crossbar 318 can comprise one or more mounting points 320.

Figure 10:
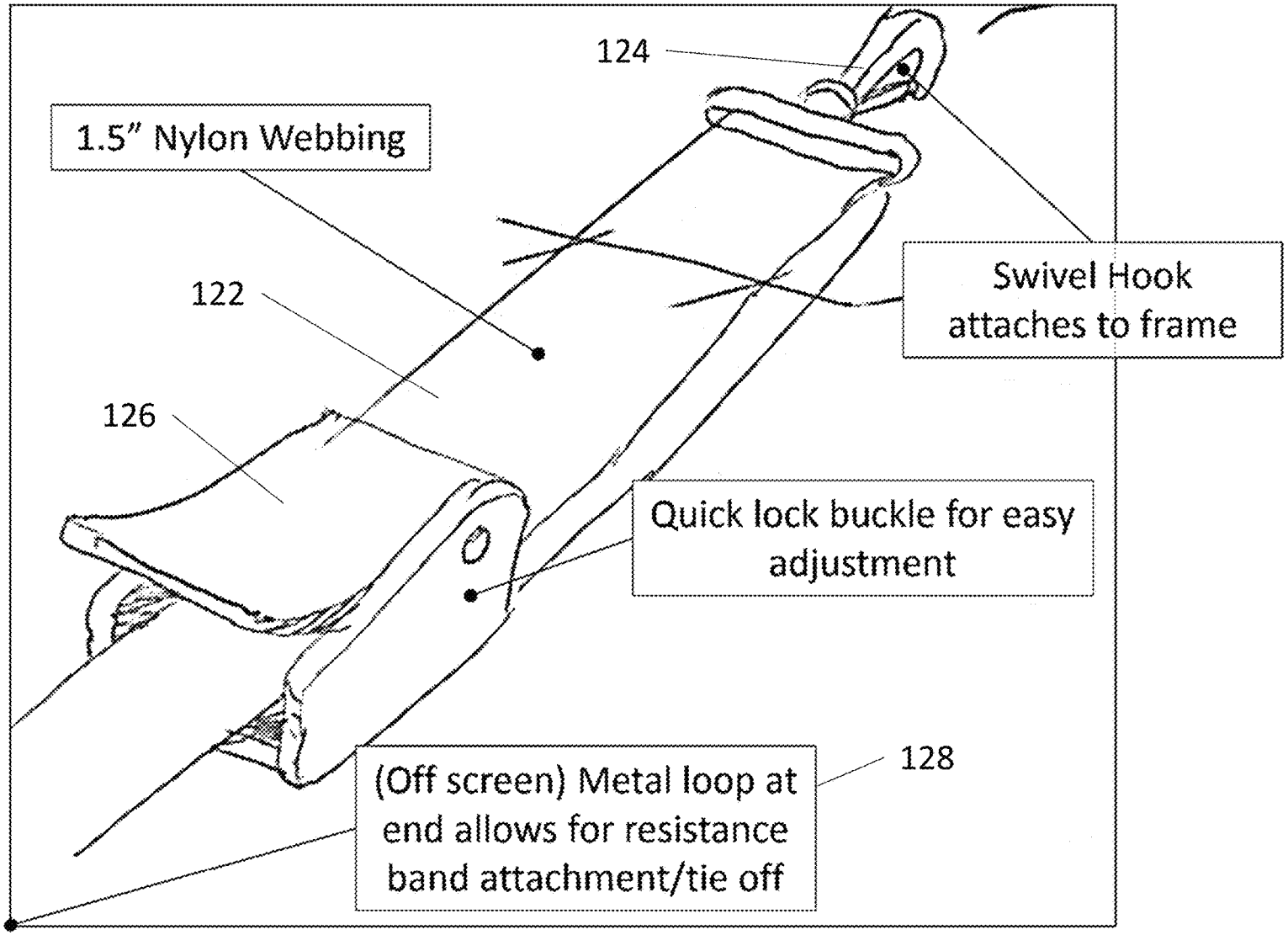
FIG. 10 depicts an exemplary mounting strap compatible with the resistance training devices of the present invention.

Referring now to FIG. 10, an exemplary mounting strap 122 is depicted. Mounting strap 122 is mountable to any of the mounting points and eyelets of the training devices of the present invention. Mounting strap 122 comprises a swivel hook 124 at a first end, a loop 128 at a second end, and a length in between. The length of mounting strap 122 can be between about 6 inches and 36 inches. In some embodiments, mounting strap 122 can be adjusted to any length by buckle 126. Swivel hook 124 is attachable to any eyelet or mounting point, including but not limited to eyelet 116, mounting point 120, mounting point 220, and mounting point 320. Loop 128 is attachable to any suitable resistance band as would be understood by those having ordinary skill in the art. Mounting strap 122 can be constructed from any suitably durable, flexible material such as nylon, polyester, polypropylene, and the like.

The components of the training devices of the present invention can be modified in any suitable manner to enhance their function. For example, in some embodiments, components of the devices can be telescoping with adjustable dimensions, including the arms, crossbars, brackets, backboards, and the like. In some embodiments, the crossbars are repositionable along each arm. In some embodiments, the training devices can include one or more motorized knobs, such that the position of the arms and the actuation of the clamping knobs can be adjusted using push-button controls. In some embodiments, the motorized knobs can be controlled wirelessly. In some embodiments, the various components of the devices are interchangeable.

The training devices of the present invention can be constructed from any suitable material. In some embodiments, the components of the devices are constructed using a durable, stiff, and lightweight material or combinations thereof, including but not limited to aluminum, polystyrene, polyethylene terephthalate (PET), and the like. The training devices of the present invention can be constructed using any suitable method known in the art. The methods may vary depending on the materials used. For example, certain components can substantially comprise a plastic or polymer that may be milled from a large block or injection molded. Likewise, certain components can substantially comprise a metal that may be milled, cast, etched, or deposited by techniques such as chemical vapor deposition, spraying, sputtering, and ion plating. In some embodiments, the devices may be made using 3D printing techniques commonly used in the art.

The present invention also includes kits comprising the training devices described elsewhere herein. The kits may provide one or more training devices with one or more mounting straps and one or more resistance bands. In some embodiments, the devices can be provided with one or more additional arms and crossbars, wherein each arm and crossbar can have different dimensions and are interchangeable with other arms and crossbars. In some embodiments, the kits may further comprise instructional material for using the devices, including but not limited to mounting instructions, resistance band use, tension and length adjustments, exercise techniques, training regimens, and the like.

Methods of Use

The present invention also provides methods for full body resistance training using the devices described elsewhere herein. The methods relate to the secure attachment of the training devices to a planar edge and to the adjustment of resistance band positioning for optimal anatomic placement.

The training devices are useful for any suitable user in need of rehabilitation or exercise. In some embodiments, the user is a patient having muscular disorder, disease, or degeneration, including but not limited to muscular dystrophy, muscular atrophy, congenital myopathy, amyotrophic lateral sclerosis, sarcopenia, and the like. In some embodiments, the user is a subject having one or more mobility issues and is temporarily or permanently bedridden. In some embodiments, the user is a subject having one or more physical injuries and is in need of low impact exercises.

One or more resistance bands may be mounted to the training devices. In some embodiments, the resistance bands may be directly mounted to the training devices, such as by looping around or hooking to a mounting point. In some embodiments, the resistance bands may be mounted to a mounting strap that is mounted to the training devices. A mounting strap may be desirable when used in combination with resistance bands that cannot be adjusted for length. The mounting strap thereby enables the resistance bands to be adjusted to a position where a user can comfortably reach the resistance bands from a neutral position of the hands, arms, legs, or feet, limiting injury when completing an exercise. For example, in an exemplary embodiment, a training device having two arms and a crossbar can have two outer resistance bands, each outer resistance band attached to an arm. The outer resistance bands can have a longer length to reach a user's hands with lighter tension for upper body and core exercises. The training device can also have one or more central resistance bands attached to a crossbar or to a frame. The central resistance bands can have a shorter length to reach a user's feet or legs with greater tension for lower body exercises.

As described elsewhere herein, the training devices of the present invention are attachable to any suitable planar edge. In a non-limiting example, relative to a user lying horizontally on a bed, the training device can be anchored: to a headboard superior to the user; to a footboard, inferior to the user; or to a sideboard, lateral to the user. The positioning of the training device thereby enables different types of exercises. For example, anchoring a training device inferior to a user enables superior motion exercises such as curls and rowing exercises, while anchoring a training device superior to a user enables inferior motion exercises such as crunches, shoulder presses, and leg presses. In some embodiments, multiple training devices are used in combination to support a training regimen having a plurality of superior motion, inferior motion, and lateral motion exercises.

While training resistance can be adjusted by interchanging resistance bands having differing levels of tension, the training devices also permit tension to be adjusted by changing the position of the arms of the devices. For example, pivoting training devices can have arms adjusted to angle away from a user to increase training resistance, and sliding training devices can have arms adjusted to a higher position to increase training resistance. In various embodiments, the adjustment can be asymmetric to fit the training needs of a user.

EXPERIMENTAL EXAMPLES

The invention is further described in detail by reference to the following experimental examples. These examples are provided for purposes of illustration only, and are not intended to be limiting unless otherwise specified. Thus, the invention should in no way be construed as being limited to the following examples, but rather, should be construed to encompass any and all variations which become evident as a result of the teaching provided herein.

Without further description, it is believed that one of ordinary skill in the art can, using the preceding description and the following illustrative examples, make and utilize the compounds of the present invention and practice the claimed methods. The following working examples therefore, specifically point out exemplary embodiments of the present invention, and are not to be construed as limiting in any way the remainder of the disclosure.

Example 1: Safety and Feasibility of a Novel in-Bed Resistance Training Device in Older Inpatients Deconditioning from prolonged bedrest during hospitalization predisposes older patients to loss of mobility and the need for additional rehabilitation post-discharge. Despite recognition of the harms of prolonged bedrest and evidence that resistance training (RT) reverses deconditioning, few interventions have provided such exercise for hospitalized older adults. The following study evaluated the safety and feasibility of a novel exercise device used in a high-intensity RT routine in older age inpatients.

A lightweight, portable RT device was developed, which attaches to a hospital bed footboard and allows for over 20 exercises in 4 categories: upper-body, lower-body, back and core. Willing patients were recruited and trained to use this device with a goal of completing 7 exercises per workout. Patients included inpatients (age >70) on a general medical unit with a PT/OT order. Those having exercise limiting orthopedic or neurologic disability, and acute cardiopulmonary limitations were excluded. Each workout included exercises from each category, 10-20 isometric 3-second holds per exercise, and minimal rest. Patients were: (1) evaluated on their ability to complete each workout; (2) surveyed on their experience with the device; and (3) monitored for adverse events.

11 patients were trained using the device for an average of 2.0 total sessions per hospitalization (mean age: 80.9 years, range: 71-101; 54.5% female). Reasons for fewer sessions included early discharge, delirium, and contact precautions. Patients completed 89.3% of the exercises they performed. No adverse events were noted. 72.7% stated they would use the device on their own and 90.9% believed there is not enough exercise performed in hospitals.

This pilot study provides evidence of the safety and feasibility of a novel RT device to prevent inpatient deconditioning. Patients were eager and able to participate in RT. There were no observed fear of safety or views of high intensity RT as inappropriate for older hospitalized patients.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention. The appended claims are intended to be construed to include all such embodiments and equivalent variations.

What is claimed is:

1. A full body resistance training device comprising:

a frame having a backboard oriented in a first plane and at least one bracket oriented in a second plane parallel to the first plane, wherein the backboard and the at least one bracket are spaced apart to receive a planar edge;

at least one clamping knob attached to the backboard, wherein the at least one clamping knob is actuatable towards and away from the at least one bracket; and at least one arm attached to the frame by a connection, wherein the connection between the arm and the frame is movable and lockable between a plurality of positions, the at least one arm being oriented in a third plane non-parallel to the first and second planes, and wherein the at leasto ne arm includes an eyelet extending from a distal end of the at least one arm.

2. The device of claim 1, wherein the frame comprises at least one mounting point.

3. The device of claim 1, wherein the at least one bracket has a length that is longer than a length of the backboard.

4. The device of claim 3, wherein the length of the at least one bracket is between about 12 and 36 inches.

5. The device of claim 3, wherein the length of the backboard is between about 6 and 30 inches.

6. The device of claim 1, wherein the connection between the at least one arm and the frame is a pivoting connection or a sliding connection.

7. The device of claim 1, wherein the at least one arm comprises an eyelet.

8. The device of claim 1, wherein the at least one arm has a length between about 12 and 24 inches.

9. The device of claim 8, wherein the at least one arm is telescoping such that the length is adjustable.

10. The device of claim 1, wherein actuating the at least one clamping knob towards the at least one bracket grips a planar edge between the clamping knob and the at least one bracket to secure the frame to the planar edge.

11. The device of claim 1, wherein the planar edge is selected from the group consisting of: a bed footboard, a bed headboard, and a bed sideboard.

12. The device of claim 1, further comprising at least one mounting strap having a first end, a second end, and a length in between, wherein the first end has a swivel hook sized to fit over an eyelet or a mounting point, and the second end has a loop sized to receive a resistance band.

13. The device of claim 12, wherein the length is between about 6 and 36 inches.

14. The device of claim 12, wherein the at least one mounting strap comprises a buckle such that the length is adjustable.

15. A full body resistance training kit, comprising:

the full body resistance training device of claim 1; and at least one resistance band.

16. The kit of claim 15, further comprising at least one mounting strap having a first end, a second end, and a length in between, wherein the first end has a swivel hook sized to fit over an eyelet or a mounting point, and the second end has a loop sized to receive a resistance band.

17. A full body resistance training device comprising:

a frame having a backboard oriented in a first plane and at least one bracket oriented in a second plane parallel to the first plane, wherein the backboard and the at least one bracket are spaced apart to receive a planar edge;

at least one clamping knob attached to the backboard, wherein the at least one clamping knob is actuatable towards and away from the at least one bracket; and at least one arm attached to the frame by a connection, wherein the connection between the arm and the frame is movable and lockable between a plurality of positions, the at least one arm being oriented in a third plane non-parallel to the first and second planes, and wherein the at least one arm has a skeletal construction having one or more mounting points.

18. A full body resistance training device comprising:

a frame having a backboard oriented in a first plane and at least one bracket oriented in a second plane parallel to the first plane, wherein the backboard and the at least one bracket are spaced apart to receive a planar edge;

at least one clamping knob attached to the backboard, wherein the at least one clamping knob is actuatable towards and away from the at least one bracket; and at least one arm attached to the frame by a connection, wherein the connection between the arm and the frame is movable and lockable between a plurality of positions, the at least one arm being oriented in a third plane non-parallel to the first and second planes, and wherein the at least one arm is rigidly secured to an adjacent arm by at least one crossbar.

19. The device of claim 18, wherein the at least one crossbar comprises one or more mounting points.

* * * * *